US005251808A

United States Patent [19]

Rudd

[11] Patent Number: 5,251,808

[45] Date of Patent: Oct. 12, 1993

[54] VARIABLE VOLUME BOX

[76] Inventor: Darryl J. Rudd, 227 Ravencrest Rd., Yorktown Heights, N.Y. 10598

[21] Appl. No.: 997,936

[22] Filed: Dec. 29, 1992

[51] Int. Cl.[5] ..... B65D 5/54; B65D 5/56

[52] U.S. Cl. ..... 229/101.2; 220/418; 220/463; 229/235

[58] Field of Search ..... 229/101, 101.1, 101.2, 229/222, 235; 220/416, 418, 461, 462, 463

[56] References Cited

U.S. PATENT DOCUMENTS

| | | | |
|---|---|---|---|
| 1,772,625 | 8/1930 | Caulfield | 229/101.2 |
| 2,056,032 | 9/1936 | Berman . | |
| 2,305,371 | 12/1942 | Yates | 220/418 |
| 2,490,133 | 12/1949 | Inman | 229/101.2 |
| 2,493,337 | 1/1950 | Buttery | 220/416 |
| 3,128,031 | 4/1964 | Dembo | 229/101.2 |
| 3,137,437 | 6/1964 | Svensson | 220/416 |
| 3,168,234 | 2/1965 | Bartz | 229/101.2 |
| 3,291,372 | 12/1966 | Saidel . | |
| 3,302,855 | 2/1967 | Becker | 229/101.2 |
| 4,063,678 | 12/1977 | Hall . | |
| 4,139,119 | 2/1979 | McLaren | 220/461 |
| 4,720,015 | 1/1988 | Brauner | 220/461 |

FOREIGN PATENT DOCUMENTS

| | | | |
|---|---|---|---|
| 2644334 | 4/1977 | Fed. Rep. of Germany | 229/101.2 |
| 1183269 | 7/1959 | France | 229/101.2 |
| 320019 | 1/1970 | Sweden | 220/418 |
| 2035266 | 6/1980 | United Kingdom | 229/101 |

*Primary Examiner*—Gary E. Elkins
*Attorney, Agent, or Firm*—Richard C. Litman

[57] ABSTRACT

A variable volume carton box has a top a lid with flaps which are secured in the conventional manner for cereal boxes or other boxes used to contain like commodities sold in grocery stores and supermarkets. At least one intermediate circumferential perforation is located around the box so as to allow the box to be reduced in size. Once the box is reduced in size by tearing or cutting along the perforation, another set of intermediate flaps are attached circumferentially around an interior section of the carton box to form the new lid used when the box is reduced in size. If a flexible airtight lining is used within the box, a circumferential perforation or mark line is located thereon just above the circumferential perforation of the variable volume carton box to allow the lining to be folded, thereby forming an airtight lining within the reduced volume carton box.

18 Claims, 4 Drawing Sheets

VARIABLE VOLUME BOX

BACKGROUND OF THE INVENTION

1. Field of the Invention

The present invention relates to variable volume boxes such as those cartons used in grocery stores to contain such commodities as cereal, soaps, and powders. More particularly the present invention relates to those variable volume boxes having flaps located within the carton attached to the interior wall thereof so as function as the lid for the carton once the upper portion of the carton is removed.

2. Description of the Prior Art

U.S. Pat. No. 2,056,032 issued Sep. 29, 1936 to Abraham Berman discloses a variable volume box in which the outer wall is perforated at various heights, so as to be cut there along reducing the size of the box, wherein the upper outer walls of the box may be used as the flaps to close the box.

U.S. Pat. No. 3,291,372 issued Dec. 13, 1976 to William R. Saidel discloses a laminated and reclosable carton box having strips located on the outer surface thereof at various levels so as to reduce the carton in height when those strips are removed. A top box may be placed at the various levels once the levels are reduced.

U.S. Pat. No. 4,063,679 issued Dec. 20, 1977 to Richard A. Hall discloses a box construction having foldable top panels with locking gear engaging sections.

None of the above inventions and patents, taken either singly or in combination, is seen to describe the instant invention as claimed.

SUMMARY OF THE INVENTION

The variable size box of the present invention is related to those carton boxes used to contain cereals, powders, and the like typically available to consumers at grocery stores and supermarkets. The variable size carton of the present invention has a front side, a back side, a right side, a left side, as well as a top and bottom portion. On the top portion of the variable size box is a top closable lid. The top lid has a top elongated lid flap attached to the top of the front side of the box as well as a top elongated lid flap attached to the top of the back side of the box. Two side lid flaps are also located on the top portion of the box, one side lid flap being attached to the top of the right side of the box and one side lid flap being attached to the top of the left side of the box.

In this manner, one of the top elongated lid flaps, for example the front top elongated lid flap, has a tab which cooperates with a slit located on the other top elongated lid flap so as to secure the top lid. The two top side lid flaps are located below the front and back top lid flaps when the top lid is closed.

At least one perforated line is located circumferentially around the sides of the box intermediate the top and bottom portion of the box so that the box may be reduced in size as the commodity within the box is consumed. This is accomplished by cutting the box along a perforated line and disposing of the top portion of the box located above the just cut perforated line. Attached to the interior side walls of the box are intermediate lid flaps at each of the at least one perforated line so as to securely close the reduced box in the same manner as the top lid flaps.

A flexible airtight lining may also be located within the box so as to prevent moisture from reaching the commodity stored therein. The top of the airtight lining may be closed by folding the top of the lining. The airtight lining has at least one circumferential perforated line located therearound sufficiently above each of the at least one perforated line around the box to allow the lining to be reduced in size by cutting or tearing the perforated line located just above the perforated line around the box just torn or cut while leaving a sufficient amount of lining just above the torn or cut perforated line of the box to allow the lining to be folded preventing moisture from entering the lining.

Accordingly, it is a principal object of the present invention to provide a variable volume box container having an outer perforated section so as to allow the box to be reduced in size as the commodity in the box is consumed.

It is a further object of the present invention to provide a flexible airtight lining within the box having at least one perforation located around the lining to allow the lining to be reduced in size in accordance with the size of the box.

Still another object of the present invention is to provide inner flaps attached to the interior sections of the sides of the box as to provide a top closure thereof as the box is reduced in size.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
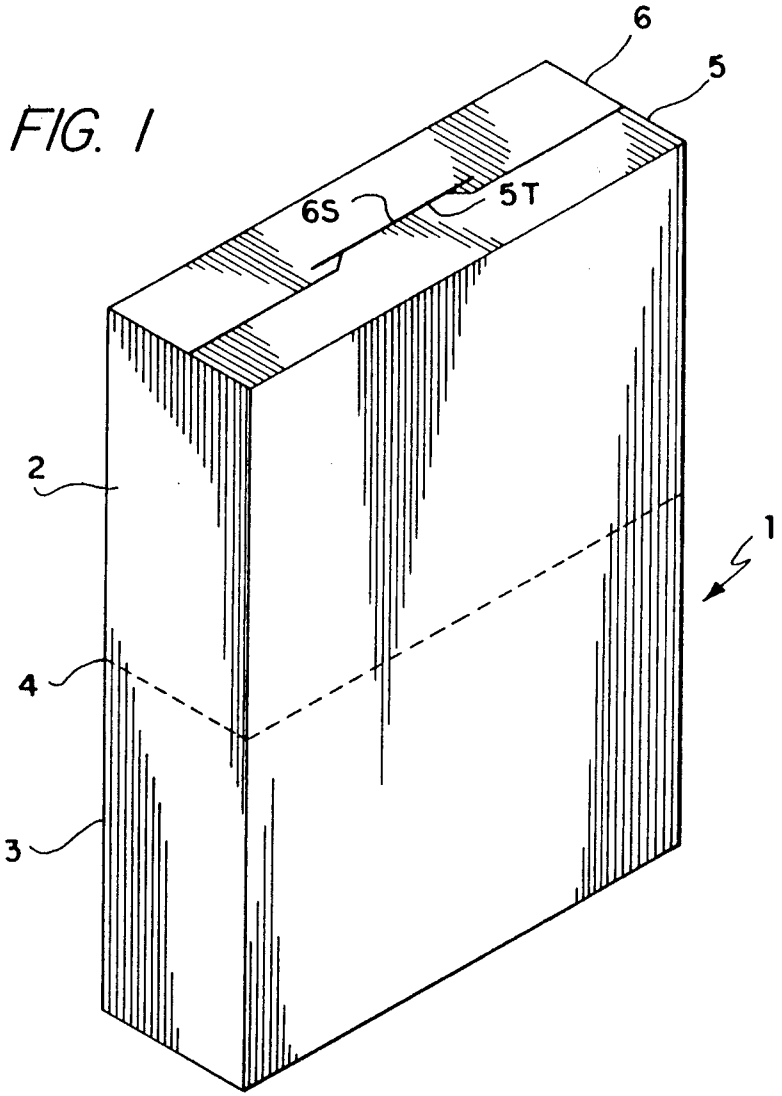
FIG. 1 is a perspective view of the present invention.

As shown in FIG. 1, the carton 1 has an upper carton portion 2 and a lower carton portion 3 separated by a perforated line 4. The top of the carton 1 has a top closable lid with an upper lid flap 5 folded over an upper lid flap 6. An upper tab portion 5T of the upper lid flap 5 is inserted into an upper slit 6S of the upper lid flap 6 to secure the top closable lid.

Figure 2:
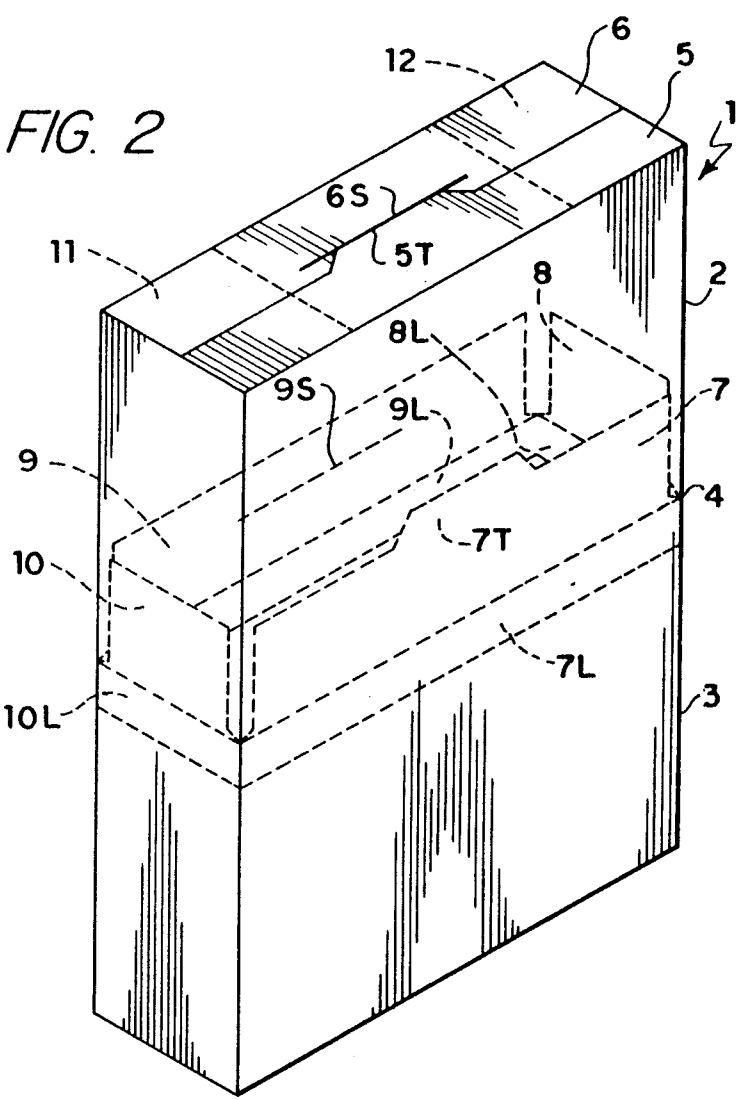
FIG. 2 is a perspective view of the present invention showing internal flaps which will be used for the top section when reduced in size.

As shown in FIG. 2, upper lid flaps 11 and 12 are folded under upper lid flaps 5 and 6. Within carton 1 is located at least one intermediate closable lid located between the top and bottom portions of the carton 1. The intermediate closable lid shown in FIG. 2 has lid flaps 7, 8, 9, and 10. Each of the intermediate lid flaps 7, 8, 9, and 10 have lower lid flaps portions 7L, 8L, 9L, and 10L, respectively, attached thereto. Each of the lower lid flap portions 7L, 8L, 9L, and 10L are in turn attached by some conventional means to the interior portion of the carton 1, e.g., glue. The intermediate lid flaps 7, 8, 9, and 10 are located above the perforated line 4, while the lower lid flap portions 7L, 8L, 9L, and 10L are located below the perforated line portions. In this manner, once the upper carton portion 2 is removed by tearing the carton along the perforated line 4, then the lower carton portion 3 has, at the top thereof, the intermediate lid flaps 7, 8, 9, and 10. While not shown in FIG. 2, the present invention may comprise more than one intermediate closable lid located between the top portion and bottom portion of the carton 1.

Figure 3:
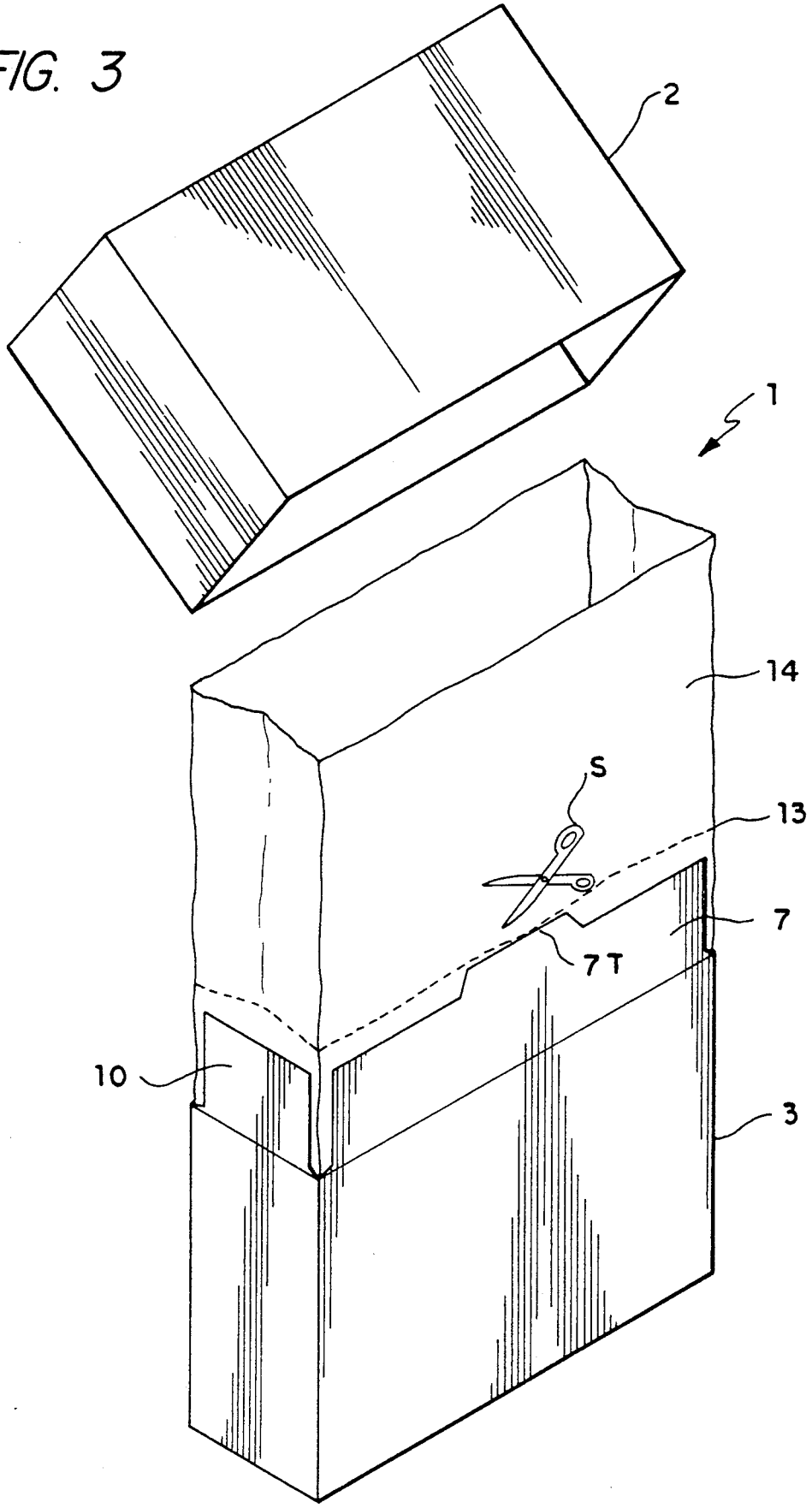
FIG. 3 is an exploded perspective view of the present invention with the top portion removed to show internal features of the invention including a first embodiment of the internal flexible airtight lining.

As shown in FIG. 3, once the upper portion 2 of the carton 1 is removed along the perforated line 4, an airtight flexible lining 14 extends above the lower lid flaps 7 and 10. The airtight flexible lining 14 is provided within the carton 1 so as prevent moisture from reaching the contents within the carton 1. The airtight flexible lining 14 has a markline 13 with an emblem S thereabove in the shape of a pair of scissors to indicate to a user to cut along the markline 13 so that the airtight flexible lining 14 may be reduced in size as the carton 1 is reduce in size.

The lower lid flaps 7, 8, 9, and 10 can be closed once the upper carton portion 2 is removed and the airtight flexible lining 14 is reduced in size by tearing the lining along the perforated line 13. In this manner the lower flaps 10 and 8 would be folded down while the flaps 9, and 7 would be folded on top. The flap 7 would fold over the flap 9 with the tab portion 7T being inserted into the slot portion 9S.

Figure 5:
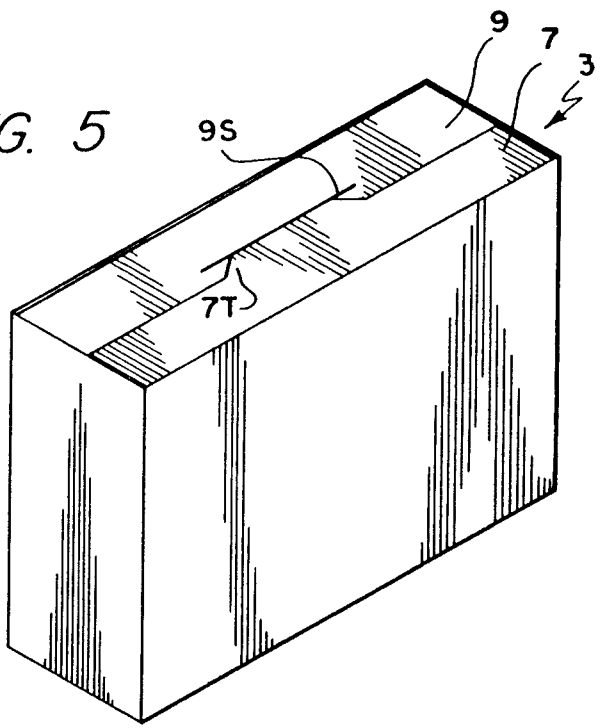
FIG. 5 is a perspective view of the box of the present invention when reduced in size.
Figure 4:
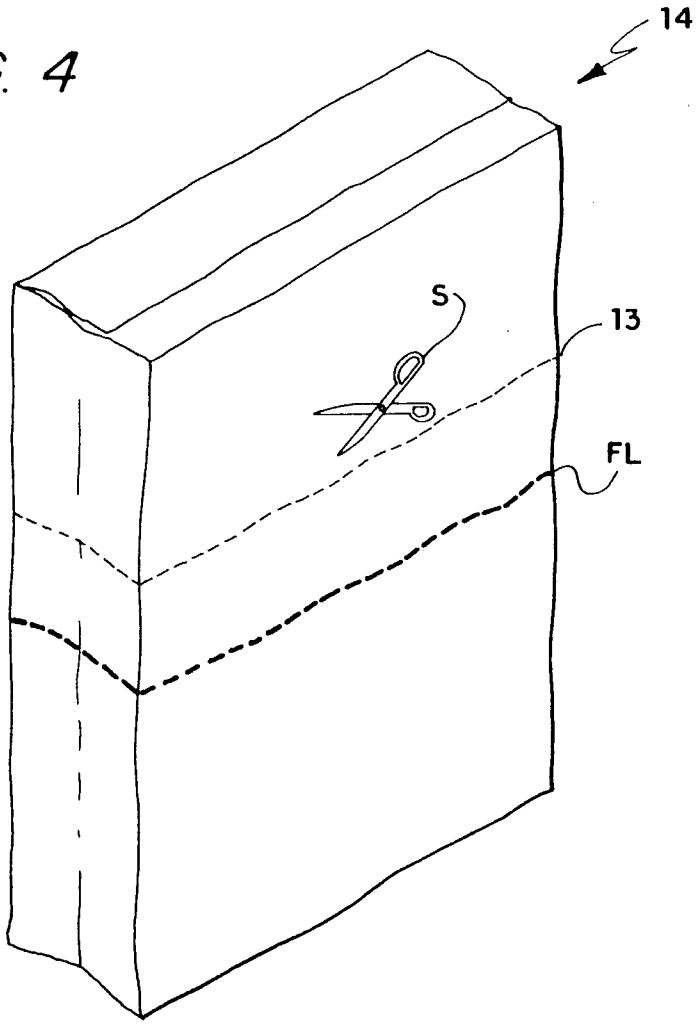
FIG. 4 is a perspective view of the first embodiment of the internal flexible airtight lining.

As shown in FIG. 4, once the food line of the commodity within the carton 1 goes below the food line FL, which is approximately at the same height as the boundary between the lower lid flaps 7, 8, 9, and 10 and the lower lid flap portions 7L, 8L, 9L, and 10L, the carton 1 may be reduced in size as discussed above. As seen in FIG. 1, and as discussed above, the perforated line portion 4 may be torn so as to remove the upper portion 2 of the carton 1. The upper portion of the flexible interior air tight lining 14 may also be removed once the user cuts along the markline 13. In this manner the carton 1 now consists of the lower portion 3 only. As shown in FIG. 5, the carton's lower portion 3 may be closed as discussed above by folding flaps 8 and 10, and then folding flaps 9 and 7. By inserting tab 7T into slot 9S the carton is securely closed.

Figure 6:
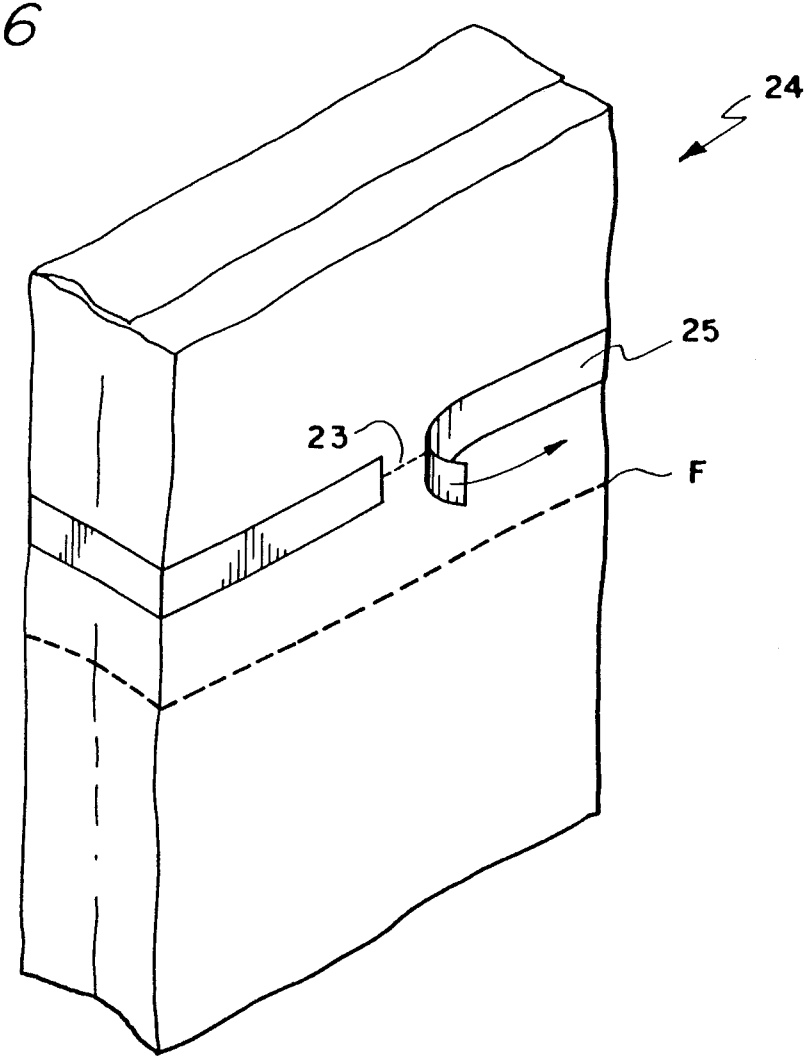
FIG. 6 is a perspective view of a second embodiment for the internal flexible airtight lining.

In FIG. 6, a second embodiment for the airtight flexible lining is shown. A perforated line 23 extends around the perimeter of the airtight flexible lining 24 a predetermined height from the bottom of the airtight flexible lining 24 in the same manner that the markline 13 extends around the airtight flexible lining 14. Since air would penetrate through the perforated line 23, a strip of tape 25 is applied to the outer portion of the airtight flexible lining 24 in such a way as to cover the perforated line 23. As illustrated in FIG. 6, once the food line of the commodity within the carton containing the airtight flexible lining 24 goes below the food line F set at a predetermined height above the bottom of the airtight flexible lining 24 in the same manner as food line FL was determined as discussed above, the tape 25 is removed and the airtight flexible lining 24 is reduced in size by tearing the lining 24 along the perforated line 23. The carton containing the airtight flexible lining 24 would be identical to carton 1, except that airtight flexible lining 14 would be replaced by airtight flexible lining 24.

It is to be understood that the present invention is not limited to the embodiments described above, but encompasses any and all embodiments within the scope of the following claims.

I claim:

1. A variable volume carton box having a front side, a back side, a right side, a left side, a top portion, and a bottom portion, said variable volume carton box comprising an upper closable lid located at the top portion thereof and at least one intermediate closable lid located within the box intermediate the top portion and the bottom portion;

wherein said at least one intermediate closable lid comprises:

a first intermediate elongated flap with a second slot located thereon;

a second intermediate elongated flap with a second tab located thereon, wherein said second tab cooperates with said second slot so as to securely close said intermediate closable lid; and third and fourth intermediate side flaps located between said first and said second intermediate elongated flaps;

whereby, said first and said second intermediate elongated flaps and said third and said fourth intermediate side flaps each have lower portions attached thereto circumferentially securing said first and said second intermediate elongated flaps and said third and said fourth intermediate side flaps to an interior portion of said variable volume carton box.

2. The variable volume carton box as claimed in claim 1, wherein said upper lid comprises:

a first top elongated flap with a first slot located thereon;

a second top elongated flap with a first tab located thereon; and third and fourth top side flaps located between said first and second top elongated flaps;

wherein said first tab and said first slot cooperate in such a manner as to securely close said upper closable lid.

3. The variable volume carton box as claimed in claim 1, further comprising at least one circumferential box perforation located intermediate said top and bottom portions.

4. The variable volume carton box as claimed in claim 2, further comprising at least one circumferential box perforation located intermediate said top and bottom portions.

5. The variable volume carton box as claimed in claim 1, further comprising at least one circumferential box perforation located intermediate said top and bottom portions.

6. The variable volume carton box as claimed in claim 2, further comprising at least one circumferential box perforation located intermediate said top and bottom portions.

7. The variable volume carton box as claimed in claim 2, further comprising flexible airtight lining located therein, wherein said flexible airtight lining comprises at least one intermediate circumferential line perforation thereon.

8. The variable volume carton box as claimed in claim 7, wherein said variable volume carton box further includes at least one strip of tape, wherein each of said at least one strip of tape is located over each of said at least one intermediate circumferential line perforation.

9. The variable volume carton box as claimed in claim 3, further comprising a flexible airtight lining located therein, wherein said flexible airtight lining comprises at least one intermediate circumferential line perforation thereon.

10. The variable volume carton box as claimed in claim 9, wherein said variable volume carton box further includes at least one strip of tape, wherein each of said at least one strip of tape is located over each of said at least one intermediate circumferential line perforation.

11. The variable volume carton box as claimed in claim 3, further comprising a flexible airtight lining located therein, wherein said flexible airtight lining comprises at least one intermediate circumferential markline thereon.

12. The variable volume carton box as claimed in claim 6, further comprising flexible airtight lining located therein, wherein said flexible airtight lining comprises at least one intermediate circumferential line perforation thereon.

13. The variable volume carton box as claimed in claim 12, wherein said variable volume carton box further includes at least one strip of tape, wherein each of said at least one strip of tape is located over each of said at least one intermediate circumferential line perforation.

14. The variable volume carton box as claimed in claim 6, further comprising a flexible airtight lining located therein, wherein said flexible airtight lining comprises at least one intermediate circumferential markline thereon.

15. The variable volume carton box as claimed in claim 9, wherein said at least one intermediate circumferential line perforation is located sufficiently above said at least one intermediate circumferential box perforation so as to allow said flexible airtight lining to be secured in an airtight fashion when said variable volume carton box is reduced in size.

16. The variable volume carton box as claimed in claim 10, wherein said at least one intermediate circumferential line perforation is located a predetermined distance above said at least one intermediate circumferential box perforation so as to allow said flexible airtight lining to be secured in an airtight fashion when said variable volume carton box is reduced in size.

17. A variable volume carton box having a front side, a back side, a right side, a left side, a top portion, and a bottom portion, said variable volume carton box comprising an upper closable lid located at the top potion thereof and at least one intermediate closable lid located within the box intermediate the top portion and the bottom portion; and further comprising a flexible airtight lining located therein, wherein said flexible airtight lining comprises at least one intermediate circumferential line perforation thereon.

18. A variable volume carton box having a front side, a back side, a right side, a left side, a top portion, and a bottom portion, said variable volume carton box comprising an upper closable lid located at the top portion thereof and at least one intermediate closable lid located within the box intermediate the top portion and the bottom portion; and further comprising a flexible airtight lining located therein, wherein said flexible airtight lining comprises at least one intermediate circumferential markline thereon.

* * * * *